US006627011B2

(12) United States Patent
Sugawara et al.

(10) Patent No.: US 6,627,011 B2
(45) Date of Patent: Sep. 30, 2003

(54) PROCESS FOR PRODUCING CONNECTOR COPPER ALLOYS

(75) Inventors: Akira Sugawara, Iwata-gun (JP); Kazuki Hatakeyama, Iwata-gun (JP); Le Ling, Iwata-gun (JP)

(73) Assignee: Dowa Mining Co., Ltd., Tokyo (JP)

( * ) Notice: Subject to any disclaimer, the term of this patent is extended or adjusted under 35 U.S.C. 154(b) by 9 days.

(21) Appl. No.: 09/910,730

(22) Filed: Jul. 23, 2001

(65) Prior Publication Data

US 2002/0006351 A1 Jan. 17, 2002

Related U.S. Application Data

(62) Division of application No. 09/663,988, filed on Sep. 18, 2000, now abandoned.

(30) Foreign Application Priority Data

Apr. 14, 2000 (JP) ..... 2000-113520

(51) Int. Cl.[7] ..... C22F 1/08
(52) U.S. Cl. ..... 148/682
(58) Field of Search ..... 148/682

(56) References Cited

U.S. PATENT DOCUMENTS 4,205,984 A * 6/1980 Smith, Jr. et al.
6,132,528 A 10/2000 Brauer et al.

FOREIGN PATENT DOCUMENTS

| | | | |
|---|---|---|---|
| DE | 2951768 | | 7/1981 |
| JP | 62-146230 | | 6/1987 |
| JP | 62-227071 | A | 10/1987 |
| JP | 62-243750 | A | 10/1987 |
| JP | 10-195562 | * | 7/1998 |

* cited by examiner

*Primary Examiner*—Sikyin Ip
(74) *Attorney, Agent, or Firm*—Frishauf, Holtz, Goodman & Chick, P.C.

(57) ABSTRACT

Copper alloy having the basic composition Cu—Zn—Sn contains 23–28 wt % Zn and 0.3–1.8 wt % Sn and satisfies the relation $6.0 \leqq 0.25X+Y \leqq 8.5$ (where X is the addition of Zn in wt % and Y is the addition of Sn in wt %). The alloy is cast into an ingot by melting and cooling over the range from the liquidus line to 600° C. at a rate of at least 50° C./min; the ingot is hot rolled at a temperature not higher than 900° C. and then subjected to repeated cycles of cold rolling and annealing at 300–650° C. to control the size of crystal grains, thereby producing a rolled strip having a 0.2% yield strength of at least 600 N/mm$^2$, a tensile strength of at least 650 N/mm$^2$, an electrical conductivity of at least 20% IACS, a Young's modulus of no more than 120 kN/mm$^2$ and a percent stress relaxation of no more than 20%.

13 Claims, No Drawings

PROCESS FOR PRODUCING CONNECTOR COPPER ALLOYS

This is a division of application Ser. No. 09/663,988 filed Sep. 18, 2000, now abandoned.

BACKGROUND OF THE INVENTION

This invention relates to copper alloys having satisfactory strength, electrical conductivity and stress relaxation characteristics that are suitable for use as materials for connectors and other electrical or electronic components, as well as small Young's modulus.

With the recent advances in electronics, the wire harnessing in various machines has increased in the degree of complexity and integration and this in turn has led to the growth of wrought copper materials for use in connectors and other electrical or electronic components.

The demands required of materials for connectors and other electrical or electronic components include lightweightness, high reliability and low cost. To meet these requirements, copper alloy materials for connectors are becoming smaller in thickness and in order to press them into complex shapes, they must have high strength and elasticity, as well as good electrical conductivity and press formability.

Specifically, electrical terminals must have sufficient strength that they will not buckle or deform during connection and disconnection or upon bending, as well as sufficient strength to withstand caulking of electrical wires and connector fitting followed by holding in position. To meet this need, electrical materials for use as terminals are required to have a 0.2% yield strength of at least 600 N/mm$^2$, preferably at least 650 N/mm$^2$, more preferably at least 700 N/mm$^2$, and a tensile strength of at least 650 N/mm$^2$, preferably at least 700 N/mm$^2$, more preferably at least 750 N/mm$^2$. In addition, in order to prevent chain transfer of deterioration that may occur during pressing, terminals must have sufficient strength in a direction perpendicular to that of working operations such as rolling. To meet this need, electrical materials for use as terminals are required to have a 0.2% yield strength of at least 650 N/mm$^2$, preferably at least 700 N/mm$^2$, more preferably at least 750 N/mm$^2$ and a tensile strength of at least 700 N/mm$^2$, preferably at least 750 N/mm$^2$, more preferably at least 800 N/mm$^2$, in the perpendicular direction.

Further, in order to suppress the generation of Joule's heat due to current impression, electrical materials for use as terminals preferably have a conductivity of at least 20% IACS. Another requirement is that the materials have great enough Young's modulus to ensure that connectors of small size can produce great stress in response to small displacement but this has increased rather than reduced the production cost of terminals because the need for closer dimensional tolerances has required rigorous control not only in mold technology and pressing operations but also over variations in the thickness of strip materials to be worked upon as well as the residual stress that develops in them. Under these circumstances, it has become necessary to design a structure that uses a strip material of small Young's modulus and which undergoes a large enough displacement to allow for substantial dimensional variations. To meet this need, electrical materials for use as terminals are required to have a Young's modulus of 120 kN/mm$^2$ or less, preferably 115 kN/mm$^2$ or less, in the direction where they were wrought and a Young's modulus of 130 kN/mm$^2$ or less, preferably 125 kN/mm$^2$ or less, more preferably 120 kN/mm$^2$ or less in the perpendicular direction.

The above situation has become complicated by the fact that the frequency of mold maintenance accounts for a substantial portion of the production cost. One of the major causes of mold maintenance is worn mold tools. Since mold tools such as punches, dies and strippers wear as a result of repeated punching, bending or other press working operations, burring and dimensional inaccuracy will occur in the workpiece. The effect of the material itself on the wear of mold tools is by no means negligible and there is a growing need to reduce the likelihood of the material for causing mold wear.

Connectors are required to have high resistance to corrosion and resistance to stress corrosion cracking. Since female terminals are subject to thermal loading, they must also have good anti-stress relaxation characteristics. Specifically, their stress corrosion cracking life must be at least three times as long as the value for the conventional class 1 (specified by Japanese Industrial Standard, or JIS) brass and their percent stress relaxation at 150° C. must be no more than one half the value for the class 1 brass, typically 25% or less, preferably 20% or less and more preferably 15% or less.

Brasses and phosphor bronzes have heretofore been used as connector materials. The lower-cost brass, even if its temper grade is H08 (spring), has a yield strength (proof stress) and a tensile strength of about 570 N/mm$^2$ and 640 N/mm$^2$, respectively, thus failing to satisfy the above-mentioned minimum requirements for yield strength (≧600 N/mm$^2$) and tensile strength (≧650 N/mm$^2$). Brass is also poor not only in resistance to corrosion, resistance to stress corrosion cracking, but also in anti-stress relaxation characteristics. Phosphor bronze has good balance between strength, resistance to corrosion, resistance to stress corrosion cracking, and anti-stress relaxation characteristics; on the other hand, the electrical conductivity of phosphor bronze is small (12% IACS for spring phosphor bronze) and an economic disadvantage also results.

Many copper alloys have been developed and proposed to date with a view to solving the aforementioned problems. Most of them have various elements added in small amounts such that they keep in a balance between important characteristics such as strength, electrical conductivity and stress relaxation. However, their Young's modulus was as high as 120–135 kN/mm$^2$ in the direction where the alloy was wrought and in the range of 125–145 kN/mm$^2$ in the perpendicular direction. In addition, their cost was high.

Under these circumstances, researchers are most recently having a new look at brass and phosphor bronze because they both have small enough Young's moduli (110–120 kN/mm$^2$ in the direction where the alloy is wrought and 115–130 kN/mm$^2$ in the perpendicular direction) to meet the aforementioned design criteria. Thus, it is desired to develop a copper alloy that is available at a comparable price to brasses and which exhibits a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction in which the alloy is wrought while exhibiting a 0.2% yield strength of at least 650 N/mm$^2$, a tensile strength of at least 700 N/mm$^2$ and a Young's modulus of no more than 130 kN/mm$^2$ in the perpendicular direction.

Connector materials are given Sn plating in an increasing number of occasions and the usefulness of alloys is enhanced by incorporating Sn. Inclusion of Zn as in brasses increases the ease with which to produce alloys having a good balance between strength, workability and cost. From this viewpoint, Cu—Zn—Sn alloys may well be worth attention and known examples are copper alloys having designations ranging from C40000 to C49900 that are specified by the CDA (Copper Development Association), U.S.A. For example, C42500 is a Cu-9.5Zn-2.0Sn-0.2P alloy and well known as a connector material. C43400 is a Cu-14Zn-0.7Sn alloy and used in switches, relays and terminals, though in small amounts. However, little use as connector materials is made of Cu—Zn—Sn alloys having higher Zn contents. In other words, increased Zn and Sn contents lower hot workability and unless thermo-mechanical treatments are properly controlled, various characteristics such as the mechanical ones desired for the connector materials cannot be developed and, what is more, nothing has been known about the appropriate Zn and Sn contents and the conditions for producing the desired connector materials.

Specific examples of copper alloys containing more Zn than C42500 include C43500 (Cu-18Zn-0.9Sn), C44500 (Cu-28Zn-1Sn-0.05P) and C46700 (Cu-39Zn-0.8Sn-0.05P) and they are fabricated into sheets, rods, tubes and other shapes that only find use in musical instruments, ships and miscellaneous goods but not as wrought materials for connectors, particularly as strips. Even these materials fail to satisfy all requirements for connector materials, representative examples of which are as follows:

(1) that they have a 0.2% yield strength of at least 600 $N/mm^2$, a tensile strength of at least 650 $N/mm^2$, a Young's modulus of no more than 120 $kN/mm^2$, an electrical conductivity of at least 20% IACS and a percent stress relaxation of no more than 20% in the direction where the alloy was wrought;

(2) that they have a 0.2% yield strength of at least 650 $N/mm^2$, a tensile strength of at least 700 $N/mm^2$ and a Young's modulus of no more than 130 $kN/mm^2$ in a direction perpendicular to the one where the alloy was wrought;

(3) that they have good press formability; and (4) that they have high resistance to stress corrosion cracking.

SUMMARY OF THE INVENTION

The present invention has been accomplished under these circumstances and has as an object providing a copper alloy for use as connectors that can be manufactured at low cost and which exhibits good performance in 0.2% yield strength, tensile strength, electrical conductivity, Young's modulus, anti-stress relaxation characteristics, press formability and any other qualities that are currently required of materials for connectors and other electrical or electronic components in view of the recent advances in electronics.

Another object of the invention is to provide a process for producing such connector copper alloys.

As a result of the intensive studies they made in order to attain the above-stated objects, the present inventors found optimum proportions of Zn and Sn in the Cu—Zn—Sn alloy that could simultaneously satisfy the above-mentioned characteristics required of materials for connectors and other electrical or electronic components. At the same time, they found that in order to implement those characteristics, the relationship between the conditions for cooling ingots and rolling them and the conditions for subsequent heat treatments was extremely important. Based on this finding, the present inventors set the optimum processing and working conditions, eventually accomplishing the present invention.

Thus, according to the first aspect of the invention, there is provided a connector copper alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %), further characterized in that said alloy has a 0.2% yield strength of at least 600 $N/mm^2$, a tensile strength of at least 650 $N/mm^2$, an electrical conductivity of at least 20% IACS, a Young's modulus of no more than 120 $kN/mm^2$ and a percent stress relaxation of no more than 20%.

According to the first aspect of the invention, there is also provided a connector copper alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %), further characterized in that said alloy has a 0.2% yield strength of at least 600 $N/mm^2$, a tensile strength of at least 650 $N/mm^2$, a Young's modulus of no more than 120 $kN/mm^2$, an electrical conductivity of at least 20% IACS and a percent stress relaxation of no more than 20% in the direction where said alloy was wrought whereas it has a 0.2% yield strength of at least 650 $N/mm^2$, a tensile strength of at least 700 $N/mm^2$ and a Young's modulus of no more than 130 $kN/mm^2$ in a direction perpendicular to said first direction.

Either of the copper alloys described above may further contain at least one element selected from the group consisting of 0.01–3 wt % Fe, 0.01–5 wt % Ni, 0.01–3 wt % Co, 0.01–3 wt % Ti, 0.01–2 wt % Mg, 0.01–2 wt % Zr, 0.01–1 wt % Ca, 0.01–3 wt % Si, 0.01–5 wt % Mn, 0.01–3 wt % Cd, 0.01–5 wt % Al, 0.01–3 wt % Pb, 0.01–3 wt % Bi, 0.01–3 wt % Be, 0.01–1 wt % Te, 0.01–3 wt % Y, 0.01–3 wt % La, 0.01–3 wt % Cr, 0.01–3 wt % Ce, 0.01–5 wt % Au, 0.01–5 wt % Ag and 0.005–0.5 wt % P, with the sum of the contents of said elements being 0.01–5 wt %, provided that S is present in an amount of up to 30 ppm.

According to the second aspect of the invention, there is provided a process for producing a connector copper alloy which comprises the steps of:

melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %);

cooling the melt from the liquidus line to 600° C. at a rate of at least 50° C./min; and subsequently hot rolling the resulting ingot at an elevated temperature of 900° C. or below.

According to the second aspect of the invention, there is also provided a process for producing a connector copper alloy which comprises the steps of:

melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %);

cooling the melt from the liquidus line to 600° C. at a rate of at least 50° C./min;

subsequently hot rolling the resulting ingot at an elevated temperature of 900° C. or below; and repeating the process of cold rolling and annealing in a temperature range of 300–650° C. until the as-annealed rolled strip has a crystal grain size of no more than 25 μm.

According to the second aspect of the invention, there is also provided a process for producing a connector copper alloy which comprises the steps of:

melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is the addition of Zn (in wt %) and Y is the addition of Sn (in wt %);

cooling the melt from the liquidus line to 600° C. at a rate of at least 50° C./min;

subsequently hot rolling the resulting ingot at an elevated temperature of 900° C. or below;

repeating the process of cold rolling and annealing in a temperature range of 300–650° C. until the as-annealed rolled strip has a crystal grain size of no more than 25 μm; and further performing cold rolling for a reduction ratio of at least 30% and cold annealing at 450° C. or below so that the rolled strip has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction.

In either of the processes described above, said copper alloy may further contain at least one element selected from the group consisting of 0.01–3 wt % Fe, 0.01–5 wt % Ni, 0.01–3 wt % Co, 0.01–3 wt % Ti, 0.01–2 wt % Mg, 0.01–2 wt % Zr, 0.01–1 wt % Ca, 0.01–3 wt % Si, 0.01–5 wt % Mn, 0.01–3 wt % Cd, 0.01–5 wt % Al, 0.01–3 wt % Pb, 0.01–3 wt % Bi, 0.01–3 wt % Be, 0.01–1 wt % Te, 0.01–3 wt % Y, 0.01–3 wt % La, 0.01–3 wt % Cr, 0.01–3 wt % Ce, 0.01–5 wt % Au, 0.0–5 wt % Ag and 0.005–0.5 wt % P, with the sum of the contents of said elements being 0.01–5 wt %, provided that S is present in an amount of up to 30 ppm.

To produce the connector copper alloy of the invention in rolled strip form, a molten copper alloy adjusted to have the desired composition is first poured into a mold, where it is cooled from the liquidus line to 600° C. at a rate of at least 50° C./min to ensure that there will be no segregation of Zn and Sn in the resulting ingot. The ingot is then hot rolled at an elevated temperature not higher than 900° C., say, at about 800° C. and subsequently quenched to produce a hot rolled strip having a homogeneous structure of moderately sized crystal grains. Thereafter, the strip is cold rolled and annealed at a temperature of 300–650° C., with the process of cold rolling and annealing being repeated the necessary times, so that the size of crystal grains in the rolled strip is no more than 25 μm. Preferably, the rolled strip is further subjected to cold rolling for a reduction ratio of at least 30% and low-temperature annealing at 450° C. or below to control the size of the crystal grains so that it has a 0.2% yield strength of at least 600 N/mm$^2$, a tensile strength of at least 650 N/mm$^2$, an electrical conductivity of at least 20% IACS, a Young's modulus of no more than 120 kN/mm$^2$ and a percent stress relaxation of no more than 20% in the direction where it was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction.

DESCRIPTION OF THE PREFERRED EMBODIMENT

The present invention will now be described in greater detail.

[Criticality of the Proportions of Alloying Elements]

Zn: Zinc (Zn) is desirably added in large amounts since it contributes to enhanced strength and spring quality and is available at a lower price than Cu. If its addition exceeds 28 wt %, extensive intergranular segregation occurs in the presence of Sn, causing significant drop in hot workability. Also unfavorably affected are cold workability and resistance to corrosion, and resistance to stress corrosion cracking. Platability and solderability which are sensitive to moisture and heat are also deteriorated. If the addition of Zn is smaller than 23 wt %, strength and spring quality that are typified by 0.2% yield strength and tensile strength are insufficient and Young's modulus increases. What is more, if scrap that was surface treated with Sn is used as the material to be melted, the resulting melt will occlude an increased amount of hydrogen gas to produce an ingot in which blow holes are highly likely to occur. Since Zn is an inexpensive element, using less than 23 wt % of it is an economical disadvantage. For these reasons, the Zn content is specified to range from 23 to 28 wt %. A preferred range is from 24 to 27 wt %. The small range for the Zn content is one of the basic requirements of the present invention.

Sn: Tin (Sn) has the advantage that it need be used in a very small amount to be effective in improving mechanical characteristics such as strength and elasticity typified by 0.2% yield strength and tensile strength without increasing Young's modulus. Since Sn is an expensive element, materials having a surface Sn coat such as tin plating can be put into a recycle path and this is another reason why incorporating Sn is preferred. However, if the Sn content increases, electrical conductivity drops sharply and extensive intergranular segregation occurs in the presence of Zn, causing significant drop in hot workability. In order to ensure the desired hot workability and an electrical conductivity of at least 20% IACS, the addition of Sn should not exceed 1.8 wt %. If the addition of Sn is less than 0.3 wt %, there will be no improvement in mechanical characteristics and chips or the like that result from the pressing of tin-plated or otherwise tin-coated scrap are difficult to use as the material to be melted. Therefore, the content of Sn is specified to range from 0.3 to 1.8 wt %, preferably from 0.6 to 1.4 wt %.

If Zn and Sn are contained in the amounts specified above and if they satisfy the following relation (1), preferably the following relation (2), the Zn- and Sn-rich phases that precipitate at grain boundaries under high temperature as when casting or hot rolling is performed can be effectively controlled to produce a copper alloy that has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought, that has a 0.2% yield strength of at least 650 N/mm$^2$, a tensile strength of at least 700 N/mm$^2$ and a Young's modulus of no more than 130 kN/mm$^2$ in a direction perpendicular to said first direction, and that also has the characteristics required for use as connector materials, as exemplified by resistance to corrosion, resistance to stress corrosion cracking (having a cracking life in ammonia vapor which is at least three times the value for class 1 brass), anti-stress relaxation characteristics (the percent stress relaxation at 150° C. being no more than one half the value for class 1 brass and comparable to phosphor bronze), and efficient punching on a press:

$$6.0 \leqq 0.25X+Y \leqq 8.5 \quad (1)$$

$$6.4 \leqq 0.25X+Y \leqq 8.0 \quad (2)$$

where X is the addition of Zn (in wt %) and Y is the addition of Sn (in wt %).

The content of S as an impurity is desirably held to a minimum. Even a small amount of S will markedly reduce the working capacity, or deformability, in hot rolling. Two typical sources for the entrance of S is scrap that has been plated with tin in a sulfate bath and oils for working such as pressing; controlling the value of S content is effective for preventing cracking in the process of hot rolling. In order to have this effect come into being, S should not be present in an amount greater than 30 ppm, preferably no more than 15 ppm.

Besides Zn and Sn, a third alloying element may be added and it is at least one element selected from the group consisting of 0.01–3 wt % Fe, 0.01–5 wt % Ni, 0.01–3 wt % Co, 0.01–3 wt % Ti, 0.01–2 wt % Mg, 0.01–2 wt % Zr, 0.01–1 wt % Ca, 0.01–3 wt % Si, 0.01–5 w % Mn, 0.01–3 wt % Cd, 0.01–5 wt % Al, 0.01–3 wt % Pb, 0.01–3 wt % Bi, 0.01–3 wt % Be, 0.01–1 wt % Te, 0.01–3 wt % Y, 0.01–3 wt % La, 0.01–3 wt % Cr, 0.01–3 wt % Ce, 0.01–5 wt % Au, 0.01–5 wt % Ag and 0.005–0.5 wt % P, with the sum of the contents of these elements being 0.01–5 wt %.

These elements can enhance strength without substantial deterioration in electrical conductivity, Young's modulus and machinability. If the ranges for the contents of the respective elements are not observed, the stated effect is not attained or, alternatively, disadvantages will result in various aspects such as hot workability, cold workability, press formability, electrical conductivity, Young's modulus and cost.

[Criticality for Manufacturing Conditions]

The first step in the process of the present invention for producing hot rolled, copper alloy strips is melting the copper alloy of the invention and casting the melt into an ingot. If scrap having a surface Sn coat, in particular chips resulting from punching on a press, are to be melted, a preliminary heat treatment is preferably performed in air atmosphere or an inert atmosphere at a temperature of 300–600° C. for 0.5–24 hours. If the temperature is below 300° C. the pressing oil adhering to the chips is not completely burnt; what is more, the moisture that has been absorbed during storage is not fully dried and if the melting step is subsequently initiated by rapid temperature elevation, the moisture is decomposed to evolve hydrogen gas which is taken up by the melt to generate blow holes.

If the melting is done at a temperature higher than 600° C., oxidation proceeds so rapidly as to induce dross formation. If dross forms, the melt becomes viscous and the efficiency of the casting operation decreases. Therefore, the temperature for the preliminary heat treatment of the copper alloy to be melted is specified to lie between 300 and 600° C. if this heat treatment lasts for less than 0.5 hours, combustion of the pressing oil and drying of the moisture are accomplished only incompletely. If the time of the heat treatment is longer than 24 hours, the parent metal Cu diffuses in the Sn surface coat, where it oxidizes to form a Cu—Sn—O system oxide that is not only a dross former but also an economic bottleneck. Therefore, the time of the preliminary heat treatment of the copper alloy is specified to lie between 0.5 and 24 hours. The preliminary heat treatment will bring about satisfactory results if it is performed in air atmosphere but providing an inert gas seal is preferred for the purpose of preventing oxidation. However, some disadvantage will result from the use of a reducing gas since at elevated temperature, the moisture decomposes to evolve hydrogen gas that is taken up by the melt to diffuse in it.

After melting the copper alloy, it is desirably cast by the continuous process which may be either vertical or horizontal, except that the melt is cooled from the liquidus line to 600° C. at a rate of at least 50° C./min. If the cooling rate is less than 50° C./min, segregation of Zn and Sn occurs at grain boundaries and the efficiency of the subsequent hot working step decreases to lower the yield. The temperature range over which the cooling rate should be held not lower than 50° C./min may be between the liquidus line and 600° C. There is no sense of controlling the cooling rate at temperatures higher than the liquidus line; below 600° C., the duration of cooling in the casting process is insufficient to cause excess segregation of Zn and Sn at grain boundaries.

After casting the melt into an ingot, hot rolling is performed under heating at a temperature not higher than 900° C. Above 900° C., intergranular segregation of Zn and Sn causes hot cracking which, in turn, leads to a lower yield. By performing hot rolling at temperatures of 900° C. and below, not only the microsegregations that occurred during the casting step but also the cast structure will disappear and the resulting rolled strip has a homogeneous structure even if it contains Zn and Sn in the amounts defined for the copper alloy according to the first aspect of the invention. Preferably, hot rolling is performed at a temperature of 870° C. or below. The crystal grains in the hot rolled strip are desirably sized to 35 μm or less. If the crystal grain size exceeds 35 μm, the latitude in control over the reduction ratio for the subsequent cold rolling and the conditions for the annealing that follow is so small that the slightest departure may potentially produce mixed crystal grains, leading to deteriorated characteristics.

After hot rolling, the surface of the strip may be planed as required. Subsequently, cold rolling and annealing in the temperature range of 300–650° C. are repeated until the crystals in the as-annealed material have a grain size of no more than 25 μm. Below 300° C., it takes an uneconomically prolonged time to control the crystal grains; above 650° C., the crystal grains become coarse in a short time. If the size of the crystal grains in the as-annealed material exceeds 25 μm, mechanical characteristics, in particular 0.2% yield strength, or workability deteriorates. Preferably, the crystal grain size is reduced to 15 μm or below, more preferably 10 μm or below.

The thus annealed material is subjected to cold rolling for a reduction ratio of at least 30% and cold annealing at 450° C. or below so as to produce a copper alloy that has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in the direction where said alloy was wrought whereas it has a 0.2% yield strength of at least 650 N/mm$^2$, a tensile strength of at least 700 N/mm$^2$ and a Young's modulus of no more than 130 kN/mm$^2$ in a direction perpendicular to said first direction. If the reduction ratio in cold rolling is less than 30%, the improvement in strength that is achieved by work hardening is insufficient to achieve the desired improvement in mechanical characteristics. The reduction ratio is preferably at least 60%. Low-temperature annealing is necessary to improve 0.2% yield strength, tensile strength, spring limit value and anti-stress relaxation characteristics. Beyond 450° C., so large a heat capacity is applied that the work softens in a short time. Another difficulty is that variations in the characteristics of the work are prone to occur in both a batch and a continuous system. Hence, cold annealing should be performed at temperatures not higher than 450° C.

The thus obtained material may optionally be subjected to surface treatments to provide a Cu undercoat 0.3–2.0 μm thick and a Sn surface film 0.5–5.0 μm thick before it is put to service. If the Cu undercoat is thinner than 0.3 μm, it is by no means effective in preventing the Zn in the alloy from diffusing into the Sn surface coat and to the surface where it is oxidized to increase contact resistance while reducing solderability. If the Cu undercoat is thicker than 2.0 μm, its effect is saturated and there is no economic advantage. The Cu undercoat need not be solely made of pure copper but may be composed of a copper alloy such as Cu—Fe or Cu—Ni.

If the Sn surface coat is thinner than 0.5 μm, the desired resistance to corrosion, particularly to hydrogen sulfide, is not obtained. If the Sn surface coat is thicker than 5.0 μm, its effect is saturated and an economic disadvantage will simply result. To secure uniformity in film thickness and economy, the surface treatments for providing the Cu undercoat and the Sn surface coat are preferably performed by electroplating. The Sn surface coat may be reflowed to improve its gloss. This treatment is also effective as a means of preventing Sn whiskers.

The thus treated material is pressed into electric terminals, which may subsequently be heat treated at a temperature of 100–280° C. for a duration of 1–180 minutes. This heat treatment is not only effective for improving on the spring limit value and anti-stress relaxation characteristics that have deteriorated as the result of press working but also instrumental to the prevention of whiskers. Below 100° C., these effects of the heat treatment are not fully attained; above 280° C., diffusion and subsequent oxidation not only increase the contact resistance but also lower the solderability and workability. If the duration of the heat treatment is shorter than 1 minute, its effects are not fully attained; if it continues longer than 180 minutes, diffusion and subsequent oxidation bring about the unwanted results just mentioned above and, in addition, there is no economic advantage.

The following examples are provided for the purpose of further illustrating the present invention but are in no way to be taken as limiting.

EXAMPLE 1

Copper alloy sample Nos. 1–6 having the compositions (wt %) shown in Table 1 were melted at temperatures 70° C. higher than their liquidus lines, fed into a small vertical continuous casting machine and cast into ingots measuring 30×70×1000 (mm). The rate of cooling from the liquidus line to 600° C. was adjusted to be in treat excess of 50° C./min by controlling the primary cooling with the mold and the secondary cooling with a shower of water.

The ingots were heated to 800–840° C., hot rolled to a thickness of 5 mm and checked for surface or edge cracks to evaluate their hot workability. The samples are rated ○ if no cracks are found under examination with an optical microscope (×50) after pickling; otherwise, rating X is given. Hot rolling was allowed to end at about 600° C. and by subsequent quenching, the size of the crystal grains in the as-rolled ingot was controlled to about 30 μm. The ingots were then cold rolled to a thickness of 1 mm and annealed at temperatures of 450–520° C. so that the crystal grain size was adjusted to about 10 μm. After pickling, the ingots were cold rolled to a thickness of 0.25 mm and low-temperature annealed at 230° C. in the final step.

From each of thus produced strips, test pieces were sampled and measured for 0.2% yield strength, tensile strength, Young's modulus, electrical conductivity, percent stress relaxation and stress corrosion cracking life. The first three parameters were measured by the test methods described in JIS Z2241, provided that small (70 mm long) test pieces were used for measurements in a direction perpendicular to the rolling direction. Electrical conductivity was measured by the method described in JIS H0505. In the stress relaxation test, a bending stress representing 80% of the 0.2% yield strength was applied to the surface of each sample, which was held at 150° C. for 500 hours to measure the amount of bend. The percent stress relaxation was calculated by the following equation (3):

$$\text{Stress relaxation } (\%) = [(L1-L2)/(L1-L0)] \times 100 \quad (3)$$

where

L0: length (mm) of the jig

L1: initial length (mm) of a sample

L2: horizontal distance (mm) between ends of the bent sample

In the stress corrosion cracking test, a bending stress representing 80% of the 0.2% yield strength was applied to the surface of each sample, which was exposed and held in a desiccator containing 12.5% aqueous ammonia. The exposure time was increased to 150 minutes at increments of 10 minutes. The test pieces were exposed for the specified periods, taken out of the desiccator, optionally stripped of the surface coat by pickling, and checked for cracks by examination under an optical microscope (×100). The point in time 10 minutes before any crack was observed was designated the "stress corrosion cracking life".

The results of measurements are shown in Table 1.

COMPARATIVE EXAMPLE 1

Comparative copper alloy sample Nos. 7–11 having compositions outside the invention ranges shown in Table 1 were cast and worked under the same conditions as in Example 1 to produce strips. From each of the strips, test pieces were sampled and measured for their mechanical properties, electrical conductivity and other characteristics by the same methods as in Example 1. The results are also shown in Table 1

TABLE 1

| | Sample No. | Composition (wt %) Zn | Sn | Value of eq. 1 | Others | S (ppm) | 0.2% yield strength (N/mm²) Rolling direction | Perpendicular direction | Tensile strength (N/mm²) Rolling direction | Perpendicular direction | Young's modulus (kN/mm²) Rolling direction | Perpendicular direction | Electrical conductivity (% IACS) | Hot workability | Stress relaxation (%) | Stress corrosion cracking life (min) |
|---|---|---|---|---|---|---|---|---|---|---|---|---|---|---|---|---|
| Example 1 | 1 | 24.7 | 0.84 | 7.0 | — | 13 | 755 | 822 | 812 | 932 | 108 | 117 | 24.9 | ○ | 12.6 | 120 |
| | 2 | 26.1 | 0.71 | 7.2 | — | 12 | 756 | 829 | 818 | 930 | 109 | 118 | 25.3 | ○ | 10.8 | 110 |

TABLE 1-continued

| | Sample No. | Composition (wt %) Zn | Sn | Value of eq. 1 | Others | S (ppm) | 0.2% yield strength (N/mm²) Rolling direction Perpendicular direction | Tensile strength (N/mm²) Rolling direction Perpendicular direction | Young's modulus (kN/mm²) Rolling direction Perpendicular direction | Electrical conductivity (% IACS) | Hot workability | Stress relaxation (%) | Stress corrosion cracking life (min) |
|---|---|---|---|---|---|---|---|---|---|---|---|---|---|
| | 3 | 25.0 | 0.91 | 7.2 | Ni0.18 | 12 | 763<br>840 | 831<br>951 | 110<br>118 | 22.9 | ○ | 10.8 | 120 |
| | 4 | 25.4 | 0.69 | 7.0 | Fe0.12<br>Cr0.07 | 12 | 731<br>819 | 811<br>930 | 107<br>118 | 26.1 | ○ | 12.0 | 110 |
| | 5 | 24.2 | 1.10 | 7.2 | Si0.19<br>Ti0.05 | 12 | 770<br>838 | 835<br>950 | 106<br>117 | 22.2 | ○ | 12.5 | 110 |
| | 6 | 23.6 | 0.91 | 6.8 | Al0.29<br>Mn0.31 | 14 | 750<br>818 | 811<br>916 | 108<br>117 | 23.8 | ○ | 12.1 | 110 |
| Comparative Example 1 | 7 | 24.5 | 0.19 | 6.3 | — | 13 | 673<br>699 | 714<br>802 | 118<br>124 | 26.9 | ○ | 16.9 | 100 |
| | 8 | 27.5 | 1.72 | 8.6 | — | 12 | 771<br>860 | 840<br>955 | 109<br>117 | 21.5 | X | 12.1 | 110 |
| | 9 | 21.1 | 0.44 | 5.7 | — | 13 | 671<br>713 | 725<br>822 | 108<br>119 | 27.4 | ○ | 20.1 | 120 |
| | 10 | 27.5 | 1.18 | 8.1 | — | 41 | — | — | — | — | X | — | — |
| | 11 | 30.2 | 0.22 | 7.8 | Ni0.13 | 14 | 682<br>711 | 741<br>828 | 109<br>119 | 24.4 | ○ | 22.7 | 40 |

As can be seen from Table 1, copper alloy sample Nos. 1–6 according to the present invention had good enough hot workability to allow for efficient strip manufacture, exhibited good balance between 0.2% yield strength, tensile strength, Young's modulus and electrical conductivity, and featured satisfactory anti-stress relaxation characteristics and high resistance to stress corrosion cracking. Hence, these copper alloy samples had excellent characteristics that made them particularly suitable for use as materials to be shaped into connectors and other electrical or electronic parts.

On the other hand, comparative alloy sample No. 7 having an unduly small Sn content and comparative sample No. 9 having an unduly small Zn content were inferior in 0.2% yield strength, tensile strength and anti-stress relaxation characteristics. Comparative sample No. 7 was also inferior in Young's modulus. Comparative sample No. 8 which contained Zn and Sn in the specified amounts but which exceeded the upper limit of eq. (1) was inferior in hot workability and suffered the problem of cost increase due to lower yield. Comparative sample No. 10 satisfied the conditions of Zn and Sn contents and eq. (1) but it contained an excessive amount of S as an impurity; therefore, cracks developed during hot working and even by application of subsequent cold working, the alloy could not be reduced to the final strip thickness in high yield. Comparative sample No. 11 having an excessive Zn content but an unduly small Sn content was inferior in anti-stress relaxation characteristics and resistance to stress corrosion cracking.

COMPARATIVE EXAMPLE 2

Commercial samples of class 1 brass (C26000-H08) and spring phosphor bronze (C52100-H08) were cast and worked as in Example 1 to produce strips. From each of these strips, test pieces were sampled and measured for 0.2% yield strength, tensile strength, Young's modulus, electrical conductivity, percent stress relaxation and stress corrosion cracking life by the same methods as in Example 1. The commercial samples used in this comparative example had the temper grade H08 (spring) which was of higher strength than any other grades of the same composition.

The results are shown in Table 2 together with the result for sample No. 1 of the invention that is quoted from Table 1. Data on hardness (HV) is also shown in Table 2.

TABLE 2

| | Composition (wt %) Zn | Sn | Others | 0.2% yield strength (N/mm²) Rolling direction Perpendicular direction | Tensile strength (N/mm²) Rolling direction Perpendicular direction | Young's modulus (kN/mm²) Rolling direction Perpendicular direction | Electrical conductivity (% IACS) | Hardness (HV) | Stress Relaxation (%) | Stress corrosion cracking life (min) |
|---|---|---|---|---|---|---|---|---|---|---|
| Sample No. 1 in Example 1 | 24.7 | 0.84 | — | 755<br>822 | 812<br>932 | 108<br>117 | 24.9 | 232 | 12.6 | 120 |
| Comparative Example 2 | 29.8 | — | — | 641<br>715 | 672<br>791 | 112<br>119 | 27.2 | 204 | 48.9 | 20 |
| Comparative Example 2 | — | 8.11 | P0.19 | 725<br>808 | 784<br>911 | 116<br>128 | 12.8 | 228 | 13.0 | — |

As one can see from Table 2, the copper alloy of the invention is improved, particularly in terms of 0.2% yield strength, tensile strength, anti-stress relaxation characteristics and resistance to stress corrosion cracking, as compared with brass which is a representative material for electrical or electronic components such as connectors. It is also superior to spring phosphor bronze in terms of Young's modulus and electrical conductivity. Spring phosphor bronze contains as much as 8% of expensive tin and its materials cost is liable to frequent increases. In addition, being not amenable to hot rolling, spring phosphor bronze can be produced by only limited methods and it is less advantageous in terms of total cost including production cost.

Therefore, one may safely conclude that the copper alloy of the invention has practical superiority over the existing brass and phosphor bronze series.

EXAMPLE 2

Copper alloy sample No. 12 of the composition Cu-25.1Zn-0.82Sn (wt %) which was within the scope of the invention was subject to continuous casting under varying conditions for primary and secondary cooling at varied drawing speeds. The cooling rate was measured with thermocouples which were eventually cast into ingots. The alloy had a liquidus line of about 950° C. and the average rate of cooling from this temperature to 600° C. was measured.

The ingots were subsequently heated to 840° C. and subjected to 9 passes of hot rolling for a reduction ratio of about 15% per pass; the hot rolled sheet metals were checked for surface and edge cracks by microscopic examination. The sheet metals from the ingots cast at average cooling rates of 50° C./min and above experienced no cracking at all during hot rolling. In particular, the sheet metals from the ingots cast at average cooling rates of 80° C./min and above had a greater latitude in the conditions for hot rolling in terms of both temperature and reduction ratio. On the other hand the sheet metals from the ingots cast at cooling rates slower than 50° C./min experienced cracking during hot rolling; it was therefore clear that even if the alloy composition is within the scope of the invention, cracking may develop during hot rolling if the average cooling rate in the casting process is not appropriate, with the occasional decrease in yield.

EXAMPLE 3

Sample No. 1 prepared in Example 1 was plated with a 0.45-$\mu$m thick Cu undercoat and a 1.2-$\mu$m thick reflowed Sn coat. The alloy was worked into a spring-loaded female terminal in box shape and heat treated at 190° C. for 60 minutes. This terminal and a non-heat treated terminal of the same sample were each fitted with a male terminal and the assemblies were exposed and held in a thermostatic vessel at 125° C. for 330 hours. The low-voltage low-current resistance and contact load were measured both at the initial stage and after exposure in the thermostatic vessel. The results are shown in Table 3.

TABLE 3

| | Low-voltage low-current resistance (mΩ) | | Contact load (N) | |
|---|---|---|---|---|
| | Initial | After exposure | Initial | After exposure |
| With heat treatment | 1.90 | 5.33 | 7.88 | 7.11 |

TABLE 3-continued

| | Low-voltage low-current resistance (mΩ) | | Contact load (N) | |
|---|---|---|---|---|
| | Initial | After exposure | Initial | After exposure |
| Without heat treatment (as-pressed) | 1.79 | 6.87 | 7.69 | 5.92 |

As can be seen from Table 3, heat treatment of press-formed terminals is effective for preventing the increase in low-voltage low-current resistance and the decrease in contact load that would otherwise occur after standing at high temperature. This contributes to improving the reliability of terminals made from the copper alloy according to the first aspect of the invention which is produced by the manufacturing process according to its second aspect.

EXAMPLE 4

Strips were fabricated from sample No. 1 of the invention and comparative sample Nos. 7 and 11. The strips were then shaped into sawtoothed terminals (tooth-to-tooth pitch: 1.25 mm) by punching on a press using a superhard punch and a die made of tool steel. The clearance was adjusted to 8% of the strip thickness.

After $10^6$ shots of punching operation, the development of burrs was evaluated by examining the punched surfaces in both the rolling direction and the direction perpendicular to it with an optical microscope. The terminals made from sample No. 1 had no burrs higher than 10 $\mu$m; on the other hand, the terminals made from comparative sample Nos. 7 and 11 had burrs higher than 20 $\mu$m, particularly in areas parallel to the rolling direction.

Thus, it can be seen that alloy sample No. 1 of the invention is also advantageous for preventing mold wear.

As is clear from the foregoing description, the copper alloy according to the first aspect of the invention is superior to the conventional brasses and phosphor bronzes in terms of not only the balance between 0.2% yield strength, tensile strength, electrical conductivity and Young's modulus but also anti-stress relaxation characteristics and resistance to stress corrosion cracking, as well as press formability. What is more, the alloy can be produced at low cost by the process according to the second aspect of the invention. Hence, it is an optimum alternative to brasses and phosphor bronzes as a material for connectors and other electrical or electronic components.

What is claimed is:

1. A process for producing a connector copper alloy which comprises the steps of:

(a) melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is Zn in wt % and Y is Sn in wt %;

(b) continuously casting the melt from step (a) by cooling the melt from the liquidus line to 600° C. at a rate of at least 50° C./minute to form an ingot;

(c) subsequently hot rolling the resulting ingot from step (b) at an elevated temperature of 900° C. or below;

(d) repeatedly carrying out cold rolling and annealing in a temperature range of 300 to 650° C. until the resultant as-annealed rolled strip has a crystal grain size of no more than 25 μm, and (e) subjecting the resultant copper alloy from step (d) to a surface treatment to provide a Cu containing undercoat having a thickness of 0.3 to 2 μm and a Sn containing surface film having a thickness of 0.5 to 5 μm.

2. The process according to claim 1, further comprising, prior to the melting, carrying out a preliminary heat treatment at a temperature of 300 to 600° C. for 0.5 to 24 hours in an atmosphere of air or in an inert atmosphere.

3. The process according to claim 2, wherein the hot rolling is carried out at a temperature of 870° C. or below.

4. The process according to claim 3, wherein step (d) is continued until the crystal grain size is 15 μm or below.

5. The process according to claim 3, wherein step (d) is continued until the crystal grain size is 10 μm or below.

6. A process for producing an electric terminal comprising heat treating the copper alloy from claim 1 at a temperature of 100 to 280° C. for 1 to 180 minutes.

7. A process for producing a connector copper alloy which comprises the steps of:

(a) melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is Zn in wt % and Y is Sn in wt %;

(b) continuously casting the melt from step (a) by cooling the melt from the liquidus line to 600° C. at a rate of at least 50° C./minute to form an ingot;

(c) subsequently hot rolling the resulting ingot from step (b) at an elevated temperature of 900° C. or below; and (d) subjecting the resultant copper alloy from step (c) to a surface treatment to provide a Cu containing undercoat having a thickness of 0.3 to 2 μm and a Sn containing surface film having a thickness of 0.5 to 5 μm.

8. The process according to claim 7, wherein in step (b), the melt is continuously cast into a mold and is cooled by a shower of water.

9. A process for producing a connector copper alloy which comprises the steps of:

(a) melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is Zn in wt % and Y is Sn in wt %;

(b) continuously casting the melt from step (a) by cooling the melt from the liquidus line to 600° C. at a rate of at least 50° C./minute to form an ingot;

(c) subsequently hot rolling the resulting ingot from step (b) at an elevated temperature of 900° C. or below;

(d) repeatedly carrying out cold rolling and annealing in a temperature range of 300 to 650° C. until the resultant as-annealed rolled strip has a crystal grain size of no more than 25 μm;

(e) further performing cold rolling at a reduction ratio of at least 30% and low temperature annealing at 450° C. or below so that the rolled strip has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in a first direction where said alloy is wrought, whereas the alloy has a 0.2% yield strength of at least 650 N/mm$^2$, a tensile strength of at least 700 N/mm$^2$ and a Young's modulus of no more than 130 kN/mm$^2$ in a second direction which is perpendicular to said first direction; and (f) subjecting the resultant copper alloy from step (e) to a surface treatment to provide a Cu containing undercoat having a thickness of 0.3 to 2 μm and a Sn containing surface film having a thickness of 0.5 to 5 μm.

10. The process according to claim 9, wherein the reduction ratio is at least 60%.

11. A process for producing a connector copper alloy which comprises the steps of:

(a) melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is Zn in wt % and Y is Sn in wt %, wherein said alloy further contains at least one element selected from the group consisting of 0.01–3 wt % Fe, 0.01–5 wt % Ni, 0.01–3 wt % Co, 0.01–3 wt % Ti, 0.01–2 wt % Mg, 0.01–2 wt % Zr, 0.01–1 wt % Ca, 0.01–3 wt % Si, 0.01–5 wt % Mn, 0.01–3 wt % Cd, 0.01–5 wt % Al, 0.01–3 wt % Pb, 0.01–3 wt % Bi, 0.01–3 wt % Be, 0.01–1 wt % Te, 0.01–3 wt % Y, 0.01–3 wt % La, 0.01–3 wt % Cr, 0.01–3 wt % Ce, 0.01–5 wt % Au, 0.01–5 wt % Ag and 0.005–0.5 wt % P, with the sum of the contents of said elements being 0.01–5 wt %, provided that S is not present in an amount greater than 30 ppm;

(b) continuously casting the melt from step (a) by cooling the melt from the liquidus line to 600°/c at a rate of at least 50° C./minute to form an ingot;

(c) subsequently hot rolling the resulting ingot from step (b) at an elevated temperature of 900° C. or below; and (d) subjecting the resultant copper alloy from step (c) to a surface treatment to provide a Cu containing undercoat having a thickness of 0.3 to 2 μm and a Sn containing surface film having a thickness of 0.5 to 5 μm.

12. A process for producing a connector copper alloy which comprises the steps of:

(a) melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is Zn in wt % and Y is Sn in wt %, wherein said alloy further contains at least one element selected from the group consisting of 0.01–3 wt % Fe, 0.01–5 wt % Ni, 0.01–3 wt % Co, 0.01–3 wt % Ti, 0.01–2 wt % Mg, 0.01–2 wt % Zr, 0.01–1 wt % Ca, 0.01–3 wt % Si, 0.01–5 wt % Mn, 0.01–3 wt % Cd, 0.01–5 wt % Al, 0.01–3 wt % Pb, 0.01–3 wt % Bi, 0.01–3 wt % Be, 0.01–1 wt % Te, 0.01–3 wt % Y, 0.01–3 wt % La, 0.01–3 wt % Cr, 0.01–3 wt % Ce, 0.01–5 wt % Au, 0.01–5 wt % Ag and 0.005–0.5 wt % P, with the sum of the contents of said elements being 0.01–5 wt %, provided that S is not present in an amount greater than 30 ppm;

(b) continuously casting the melt from step (a) by cooling the melt from the liquidus line to 600°/c at a rate of at least 50° C./minute to form an ingot;

(c) subsequently hot rolling the resulting ingot from step (b) at an elevated temperature of 900° C. or below;

(d) repeatedly carrying out cold rolling and annealing in a temperature range of 300 to 650° C. until the resultant as-annealed rolled strip has a crystal grain size of no more than 25 μm; and (e) subjecting the resultant copper alloy from step (d) to a surface treatment to provide a Cu containing undercoat having a thickness of 0.3 to 2 μm and a Sn containing surface film having a thickness of 0.5 to 5 μm.

13. A process for producing a connector copper alloy which comprises the steps of:

(a) melting an alloy that contains 23–28 wt % Zn and 0.3–1.8 wt % Sn while satisfying the following relation (1), with the balance being Cu and incidental impurities:

$$6.0 \leqq 0.25X+Y \leqq 8.5 \quad (1)$$

where X is Zn in wt % and Y is Sn in wt %, wherein said alloy further contains at least one element selected from the group consisting of 0.01–3 wt % Fe, 0.01–5 wt % Ni, 0.01–3 wt % Co, 0.01–3 wt % Ti, 0.01–2 wt % Mg, 0.01–2 wt % Zr, 0.01–1 wt % Ca, 0.01–3 wt % Si, 0.01–5 wt % Mn, 0.01–3 wt % Cd, 0.01–5 wt % Al, 0.01–3 wt % Pb, 0.01–3 wt % Bi, 0.01–3 wt % Be, 0.01–1 wt % Te, 0.01–3 wt % Y, 0.01–3 wt % La, 0.01–3 wt % Cr, 0.01–3 wt % Ce, 0.01–5 wt % Au, 0.01–5 wt % Ag and 0.005–0.5 wt % P, with the sum of the contents of said elements being 0.01–5 wt %, provided that S is not present in an amount greater than 30 ppm;

(b) continuously casting the melt from step (a) by cooling the melt from the liquidus line to 600°/c at a rate of at least 50° C./minute to form an ingot;

(c) subsequently hot rolling the resulting ingot from step (b) at an elevated temperature of 900° C. or below;

(d) repeatedly carrying out cold rolling and annealing in a temperature range of 300 to 650° C. until the resultant as-annealed rolled strip has a crystal grain size of no more than 25 μm;

(e) further performing cold rolling at a reduction ratio of at least 30% and low temperature annealing at 450° C. or below so that the rolled strip has a 0.2% yield strength of at least 600 N/mm$^2$, a tensile strength of at least 650 N/mm$^2$, a Young's modulus of no more than 120 kN/mm$^2$, an electrical conductivity of at least 20% IACS and a percent stress relaxation of no more than 20% in a first direction where said alloy is wrought, whereas the alloy has a 0.2% yield strength of at least 650 N/mm$^2$, a tensile strength of at least 700 N/mm$^2$ and a Young's modulus of no more than 130 kN/mm$^2$ in a second direction which is perpendicular to said first direction; and (f) comprises subjecting the resultant copper alloy from step (e) to a surface treatment to provide a Cu containing undercoat having a thickness of 0.3 to 2 μm and a Sn containing surface film having a thickness of 0.5 to 5 μm.

* * * * *